US007585235B2

(12) United States Patent
Misono et al.

(10) Patent No.: US 7,585,235 B2
(45) Date of Patent: Sep. 8, 2009

(54) BASEBALL OR SOFTBALL BAT

(75) Inventors: Kazunori Misono, Osaka (JP); Yutaka Yamaguchi, Osaka (JP); Toshiaki Kida, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 11/928,645

(22) Filed: Oct. 30, 2007

(65) Prior Publication Data

US 2008/0161140 A1 Jul. 3, 2008

(30) Foreign Application Priority Data

Oct. 31, 2006 (JP) ..... 2006-295920
Oct. 10, 2007 (JP) ..... 2007-264003

(51) Int. Cl.
*A63B 59/06* (2006.01)

(52) U.S. Cl. ..... 473/567; 473/566

(58) Field of Classification Search ..... 473/457, 473/519, 520, 564–568
See application file for complete search history.

(56) References Cited

U.S. PATENT DOCUMENTS 3,876,204 A * 4/1975 Moore et al. ..... 473/520
5,380,003 A * 1/1995 Lanctot ..... 473/520
5,415,398 A * 5/1995 Eggiman ..... 473/566
5,511,777 A * 4/1996 McNeely ..... 473/520
6,077,178 A * 6/2000 Brandt ..... 473/520
6,176,795 B1 * 1/2001 Schullstrom ..... 473/566

(Continued)

FOREIGN PATENT DOCUMENTS

JP 2001-190724 7/2001

(Continued)

*Primary Examiner*—Mark S Graham
(74) *Attorney, Agent, or Firm*—Troutman Sanders LLP; James E. Schutz

(57) ABSTRACT

A baseball or softball bat having improved restitution characteristic and preventing degraded hitting feeling caused by vibration or impact at the time of hitting can be provided. The baseball or softball bat including a ball hitting portion, a tapered portion and a grip portion is provided with an outer circumferential member, an inner circumferential member and a non-adhesive portion. The outer circumferential member is a cylindrical member forming at least the ball hitting portion. The inner circumferential member is arranged on the inner circumferential side of the outer circumferential member. The inner circumferential member has a tip end of the inner circumferential member positioned opposite to a taper side end as an end portion on the side of the tapered portion, fixed to the outer circumferential member. The non-adhesive portion is arranged, for preventing adhesion between the outer circumferential member and an unfixed portion of the inner circumferential member other than the tip end portion of the inner circumferential member and including the taper side end, at least on a portion of a region where the unfixed portion of the inner circumferential member and the outer circumferential member are opposite to each other.

8 Claims, 7 Drawing Sheets

U.S. PATENT DOCUMENTS

| | | | | |
|---|---|---|---|---|
| 6,398,675 | B1 * | 6/2002 | Eggiman et al. | 473/566 |
| 6,425,836 | B1 | 7/2002 | Misono | |
| 6,808,464 | B1 * | 10/2004 | Nguyen | 473/566 |
| 7,014,580 | B2 * | 3/2006 | Forsythe et al. | 473/566 |
| 2002/0091022 | A1 * | 7/2002 | Fritzke et al. | 473/566 |
| 2002/0094892 | A1 * | 7/2002 | Chauvin et al. | 473/566 |
| 2003/0153416 | A1 * | 8/2003 | Anderson | |
| 2004/0132563 | A1 * | 7/2004 | Giannetti et al. | 473/566 |
| 2004/0176197 | A1 * | 9/2004 | Sutherland | 473/564 |
| 2006/0258490 | A1 * | 11/2006 | Fitzgerald et al. | 473/564 |
| 2007/0202973 | A1 * | 8/2007 | Van Nguyen | 473/564 |
| 2008/0070726 | A1 * | 3/2008 | Watari et al. | 473/566 |

FOREIGN PATENT DOCUMENTS

| | | |
|---|---|---|
| JP | 2002-052108 | 2/2002 |
| WO | WO00/23151 | 4/2000 |

* cited by examiner

BASEBALL OR SOFTBALL BAT

This nonprovisional application is based on Japanese Patent Applications Nos. 2006-295920 and 2007-264003 filed with the Japan Patent Office on Oct. 31, 2006 and Oct. 10, 2007, respectively, the entire contents of which are hereby incorporated by reference.

BACKGROUND OF THE INVENTION

1. Field of the Invention

The present invention relates to a baseball or softball bat and, more specifically, to a baseball or softball bat having superior restitution characteristic.

2. Description of the Background Art

Baseball or softball bats formed of various materials including wood, metal such as titanium, titanium alloy and aluminum alloy, and fiber-reinforced plastic prepared by impregnating carbon fiber, glass fiber or the like with matrix resin and curing, have been available in the market.

Conventionally, in order to improve restitution characteristic of a bat, Japanese Patent Laying-Open No. 2002-052108 (Patent Document 1) discloses a bat having a tubular insert arranged on the inner circumferential side of a hitting portion and an elastomer filled between an inner wall and an outer circumferential surface of the tubular insert at the hitting portion. For further improvement of restitution characteristic, Japanese Patent Laying-Open No. 2001-190724 (Patent Document 2), for example, discloses a bat having fiber-reinforced plastic laminated on an outer circumference of a metal pipe, in which weak boundary layer is provided between the metal pipe and the fiber-reinforced plastic layer. Further, International Patent Publication No. 00/23151 (Patent Document 3) discloses a bat having a metal tubular member embedded in a tubular base forming the hitting portion of the bat, with a weak boundary layer formed on the surface of the metal tubular member. Here, the weak boundary layer is formed of a release agent such as wax or a release film such as polyethylene film, so as to prevent adhesion of members facing with each other with the weak boundary layer interposed.

The conventionally proposed bats described above, however, have the following problems. Specifically, in the bat disclosed in Patent Document 1, though different materials are laminated at the hitting portion of the bat, these layers are adhered and integrated to each other, and therefore, restitution characteristic is not much improved at the hitting portion of the bat at the time of hitting the ball. Further, dependent on the adhesion strength between the tubular insert and the inner wall of the hitting portion, the tubular insert may possibly be separated from the inner wall at the hitting portion, due to repeated hitting during use.

The bat disclosed in Patent Document 2 is said to improve restitution characteristic at the hitting portion of the bat, as the fiber-reinforced plastic layer and the metal pipe can deform independently when hitting the ball. In order to fix the position of fiber-reinforced plastic with respect to the metal pipe, however, the laminated body and the metal pipe are adhered without forming the weak boundary layer, at end portions (opposite ends in the axial direction of the bat) of the laminated body of fiber-reinforced plastic. Therefore, the laminated body does not move along the axial direction of the bat. Further, in the bat disclosed in Patent Document 3 also, the metal tubular member is embedded in the tubular base and, therefore, the metal tubular member does not move along the axial direction of the bat.

Therefore, in the bats disclosed in Patent Documents 2 and 3 above, vibration and shock of the bat at the time of hitting the ball would be alleviated, possibly at a high percentage, by energy loss due to the radial motion of the laminated body and the metal pipe or of the metal tubular member and the tubular base. As a result, such vibration and shock can be alleviated only moderately, and hence, feeling of hitting with the bat could be unsatisfactory.

SUMMARY OF THE INVENTION

The present invention was made to solve the above-described problem and its object is to provide a baseball or softball bat having improved restitution characteristic and capable of preventing degraded feel of hitting caused by vibration or shock at the time of hitting.

The present invention provides a baseball or softball bat including a ball hitting portion, a tapered portion and a grip portion, provided with an outer circumferential member, an inner circumferential member and a non-adhesive portion. The outer circumferential portion is a cylindrical member constituting at least the hitting portion. The inner circumferential member is arranged on the inner circumferential side of the outer circumferential member. The inner circumferential member has a taper side end, i.e., an end portion on the side of the tapered portion, and a tip side end positioned opposite to the taper side end, fixed on the outer circumferential member. The non-adhesive portion is arranged at least partially on a region where the outer circumferential member and an unfixed portion of the inner circumferential member are opposite to each other, in order to prevent adhesion of the outer circumferential member and the unfixed portion of the inner circumferential member, that is, a portion other than the tip side end and including the taper side end.

In such a structure, the hitting portion is formed by the outer circumferential member and the inner circumferential member, and the outer circumferential member and the inner circumferential member are arranged with the non-adhesive portion interposed. Therefore, at the time of hitting the ball, the inner circumferential member and the outer circumferential member can deform independent from each other. Specifically, the inner circumferential member and the outer circumferential member can elastically deform more easily when hitting the ball, as compared with the outer circumferential member and the inner circumferential member adhered to each other over the entire surfaces. Because of the restoring force of the outer circumferential member and the inner circumferential member from the elastic deformation, flying distance of the hit ball can be increased. In other words, a bat having superior restitution characteristic can be realized.

In the bat, the non-adhesive portion may extend to the taper side end of the inner circumferential member.

In that case, as the non-adhesive portion extends to the end of the inner circumferential member on the side of the tapered portion, the inner circumferential member is not adhered to the outer circumferential member at the taper side end. Specifically, the inner circumferential member is fixed to the outer circumferential member at the end (tip end side of the bat) opposite to the taper side end, and the taper side end of the inner circumferential member is not bound by the outer circumferential member. Therefore, when vibration or shock occurs as the bat hits the ball, the vibration and shock can be alleviated (damped) not only by displacement of the inner and outer circumferential members in the radial direction but also by displacement of the taper side end of the inner circumferential member in the axial direction of the bat. Therefore, the vibration and shock at the time of hitting can quickly be alleviated, and hence, bad feeling caused by such vibration can be avoided.

The non-adhesive portion may have any structure, provided that it can prevent adhesion between the inner and outer circumferential members. By way of example, the non-adhesive portion (also referred to as a weak boundary layer) may be a layer formed of a material having releasing effect. Specifically, the non-adhesive portion may be a releasing film formed of polypropylene, polyethylene, silicone or the like, or a sheet of releasing paper coated with such resin. Besides, the non-adhesive portion may be formed by applying or spraying wax-type releasing agent, silicone-based releasing agent or fluorine-based releasing agent, to the outer circumferential surface of the inner circumferential member and/or inner circumferential surface of the outer circumferential member. Further, as the non-adhesive portion, a structure in which the surface of inner circumferential member and the surface of the outer circumferential member are not adhered to each other but in slidable and/or separable contact, may be adopted.

In the bat described above, the inner circumferential member may consist of a plurality of layers laminated with other non-adhesive portions interposed, in the radial direction of the outer circumferential member. Tip side ends of the plurality of layers may be fixed to each other. At least one of the other non-adhesive portions may extend to the taper side end of the inner circumferential member. Further, in the bat described above, all of the other non-adhesive portions may extend to the taper side end of the inner circumferential member.

In such a case, as the inner circumferential member is formed of a plurality of layers, the number of layers that elastically deform independently at the time of hitting the ball can be increased. Consequently, the number of layers that generate restoring force from elastic deformation increases, and as a result, the flying distance of the ball can more reliably be increased. Further, assume that the inner circumferential member is formed by a plurality of layers while the total thickness of the inner circumferential member is not changed from when the inner circumferential member is formed of a single layer. In that case, the strength of the inner circumferential member as a whole can be made approximately equal to that when the inner circumferential member is formed of a single layer, while thickness of each of the plurality of layers is smaller than the single layer. Therefore, amount of elastic deformation of the inner circumferential member at the time of hitting becomes larger. Thus, the restoring force from elastic deformation can be increased, and the flying distance of the ball can more reliably be increased.

The bat may include a cap member covering an end of the outer circumferential member opposite to the taper side end.

In this case, as the end portion opposite to the taper side end of the outer circumferential member (that is, the tip side end of the bat) is covered by the cap member, the outer circumferential member can be prevented from directly bumping against the ground, when the batter lets go of the bat after hitting. Thus, possible damage to the outer circumferential member at the tip side end of the bat caused by bumping against the ground can be decreased.

In the bat, the cap member and the inner circumferential member may be formed integrally. As the inner circumferential member and the cap member can be formed at one time, the number of process steps in manufacturing the bat can be reduced. This lowers the manufacturing cost of the bat.

In the bat described above, the outer circumferential member may include a portion that will be a part of an end sidewall, forming an end surface of the bat, at the end opposite to the taper side end. At the portion that will be a part of the end sidewall of outer circumferential member, an opening may be formed. The inner circumferential member may include a portion that fills the opening and is adhered to the inner wall of the opening.

In that case, it becomes unnecessary to separately prepare a cap member that covers the end surface of the bat (that is, the tip end surface of the bat). Therefore, the number of components and the number of manufacturing steps of the bat can be reduced. Thus, the manufacturing cost of the bat can be reduced.

In the bat described above, the non-adhesive portion may be formed of at least one of a releasing film and a releasing agent.

In that case, by a simple method of placing the releasing film and/or releasing agent on the outer circumferential surface of the inner circumferential member in advance, the bat in accordance with the present invention can be formed. Here, the releasing film means a film body having releasing function such as a resin film formed of polypropylene, polyethylene or silicone as mentioned above, or a film having a releasing agent placed on or applied to its surface.

In the bat described above, the inner circumferential member may extend from the hitting portion to the tapered portion. In that case, as the inner circumferential member extends from the hitting portion to the tapered portion, the portion having improved restitution characteristic can be widened to the tapered portion of the bat. Therefore, even when the ball is hit at a boundary between the hitting portion and the tapered portion as is often experienced by amateur players or even at the tapered portion, the flying distance of the ball can be increased as compared with the conventional example.

By the present invention, a bat having improved restitution characteristic and not much degrading hit feeling can be realized.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
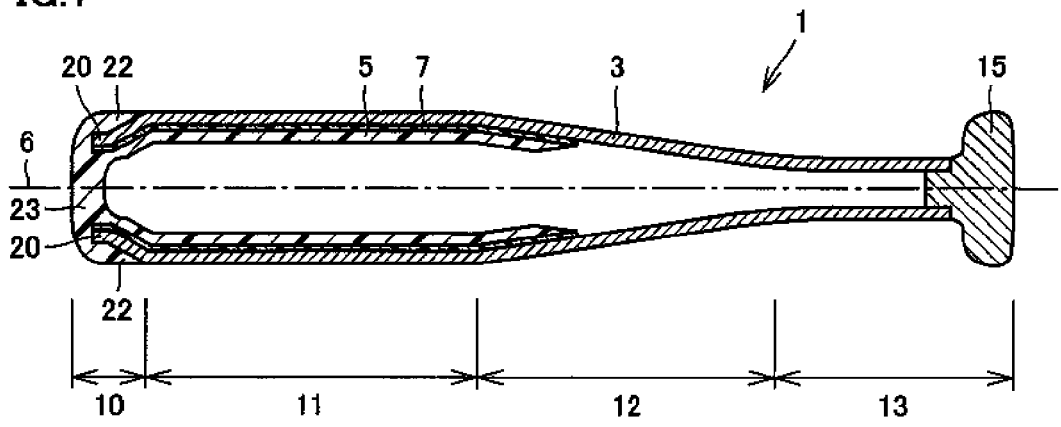
FIG. 1 is a schematic cross-section showing a structure of Embodiment 1 of the baseball or softball bat in accordance with the present invention.

In the following, embodiments of the present invention will be described with reference to the figures. Throughout the figures, the same or corresponding portions are denoted by the same reference characters, and description thereof will not be repeated.

Embodiment 1

Figure 2:
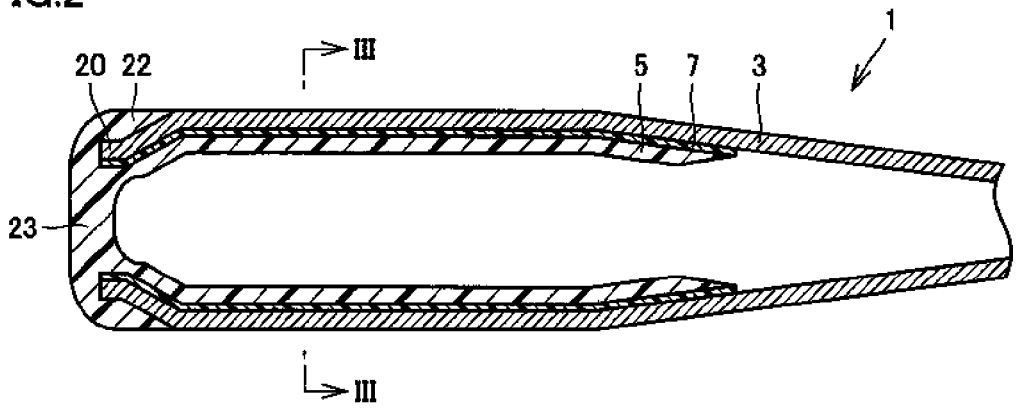
FIG. 2 is a partial, enlarged schematic cross-section of the bat shown in FIG. 1.
Figure 3:
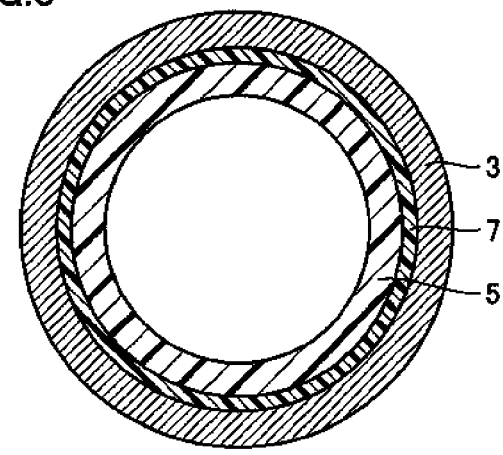
FIG. 3 is a schematic cross-section along line III-III of FIG. 2.

Referring to FIGS. 1 to 3, Embodiment 1 of the bat in accordance with the present invention will be described.

Referring to FIGS. 1 to 3, a bat 1 in accordance with the present invention includes, from the tip end side, a tip end 10, a hitting portion 11, a tapered portion 12 and a grip portion 13. Bat 1 includes an outer circumferential member 3 extending from tip end 10 to grip portion 13 and defining the shape of the bat as a whole; an inner circumferential member 5 adhered to outer circumferential member 3 on the side of tip end 10 of outer circumferential member 3; a grip end 15 connected and fixed to outer circumferential member 3 at the end of grip portion 13 (rear end of bat 1); and a non-adhesive portion 7 as a weak boundary layer (WBL) arranged between outer circumferential member 3 and inner circumferential member 5 positioned on the side of inner circumferential surface at hitting portion 1 of outer circumferential member 3. At hitting portion 11, as shown in FIG. 3, bat 1 has a three-layered structure including, from the outer circumferential side, outer circumferential member 3, non-adhesive portion 7 and inner circumferential member 5.

Inner circumferential member 5 is arranged to extend from the tip end 10 of the bat through hitting portion 11 to tapered portion 12. A tip end portion 23 of inner circumferential member has an inner circumferential member extension 22 positioned to turn over the outer circumferential side of tip end 20 of the outer circumferential member. The extension 22 of inner circumferential member and tip end 20 of outer circumferential member are adhered to each other. Tip end 20 of outer circumferential member has an inclined side surface such that its diameter becomes gradually smaller toward the tip end of bat 1, as compared with the diameter of outer circumferential member 3 at the hitting portion 11.

Inner circumferential member 5 has a cylindrical shape conforming to the inner circumferential surface of outer circumferential member 3. Further, between inner circumferential member 5 and outer circumferential member 3, non-adhesive portion 7 is arranged as described above. Non-adhesive portion 7 is formed of a film of releasing resin such as polypropylene (PP). Non-adhesive portion 7 formed of such a film is arranged to cover outer circumferential surface of inner circumferential member 5 opposite to the inner circumferential surface of outer circumferential member 3. Further, non-adhesive portion 7 is arranged to extend from the tapered side end 12 of inner circumferential member 5 to the tip end of tip side end 20 of outer circumferential member. As a result, inner circumferential member 5 is adhered to outer circumferential member 3 at tip end portion 10 of bat 1, while the end portion of inner circumferential member 5 on the side of tapered portion 12 of bat 1 is not adhered to the inner circumferential surface of outer circumferential member 3, as non-adhesive portion 7 is posed therebetween. As a result, the end portion of inner circumferential member 5 on the side of tapered portion 12 is not fixed to outer circumferential member 3 and is freely movable.

At grip portion 13, a grip end 15 is fixed to outer circumferential member 3 at the rear end of bat 1. Grip end 15 and outer circumferential member 3 may be fixed by an arbitrary method. By way of example, opposite wall surfaces of grip end 15 and outer circumferential member 3 may be threaded, and the end portion of grip end 15 may be screw-fixed to the rear end of outer circumferential member 3.

Characteristic structure of bat 1 above will be summarized. Bat 1 in accordance with the present invention is a baseball or softball bat including hitting portion 11, tapered portion 12 and grip portion 13, provided with outer circumferential member 3, inner circumferential member 5 and non-adhesive portion 7. Outer circumferential member 3 is a cylindrical member constituting at least the hitting portion 11. Inner circumferential member 5 is arranged on the inner circumferential side of outer circumferential member 3. Inner circumferential member 5 has a taper side end, i.e., an end portion on the side of the tapered portion 12, and a tip side end (tip end 23 of inner circumferential member) positioned opposite to the taper side end, fixed on outer circumferential member 3. Non-adhesive portion 7 is arranged at least partially on a region where outer circumferential member 3 and an unfixed portion of inner circumferential member 5 are opposite to each other, in order to prevent adhesion of outer circumferential member 3 and the unfixed portion (where non-adhesive portion 7 is arranged in FIGS. 1 and 2) of inner circumferential member 5, that is, a portion other than the tip side end (tip end 23 of inner circumferential member) and including the end on the side of tapered portion 12. Further, in bat 1 described above, non-adhesive portion 7 extends to the taper side end of inner circumferential member 5.

In such a structure, hitting portion 11 is formed by outer circumferential member 3 and inner circumferential member 5, and outer circumferential member 3 and inner circumferential member 5 are arranged with non-adhesive portion 7 interposed. Therefore, outer circumferential member 3 and the inner circumferential member 5 can elastically deform more easily when hitting the ball, as compared with outer circumferential member 3 and the inner circumferential member 5 adhered to each other over the entire surfaces.

Because of the restoring force of outer circumferential member 3 and inner circumferential member 5 from the elastic deformation, flying distance of the hit ball can be increased. In other words, a bat having superior restitution characteristic can be realized.

Further, as non-adhesive portion 7 extends to the end of the inner circumferential member 5 on the side of the tapered portion 12, inner circumferential member 5 is not adhered to outer circumferential member 3 at the end on the side of tapered portion 12. Specifically, inner circumferential member 5 is fixed to outer circumferential member 3 at the end (tip end 23 of inner circumferential member) opposite to the taper side end, and the taper side end of inner circumferential member 5 is not bound by outer circumferential member 3. Therefore, when vibration or shock occurs as bat 1 hits the ball, the vibration and shock can be alleviated/damped not only by displacement of the inner and outer circumferential members 5 and 3 in the radial direction but also by displacement of the taper side end of inner circumferential member 5 in the axial direction of bat 1. Therefore, the vibration and shock at the time of hitting can quickly be alleviated, and hence, bad feeling caused by such vibration can be avoided.

In bat 1 described above, tip end 23 of inner circumferential member including extension 22 of inner circumferential member may be regarded as a cap member of the bat. In that case, bat 1 shown in FIGS. 1 to 3 may be considered to have the cap member and inner circumferential member 5 formed integrally.

In that case, the number of process steps for manufacturing the bat can be reduced than when the cap member is prepared as a member separate from inner circumferential member 5 and attached separately to the tip end portion of bat 1. Therefore, manufacturing cost of bat 1 can be reduced.

In bat 1 described above, non-adhesive portion 7 is formed of a PP film, as a releasing film. Thus, by a simple method of placing the PP film on the outer circumferential surface of inner circumferential member 5 in advance, bat 1 in accordance with the present invention can be formed.

In bat 1 described above, inner circumferential member 5 extends from hitting portion 11 to tapered portion 12. As inner circumferential member 5 extends from hitting portion 11 to tapered portion 12, the portion having improved restitution characteristic (sweet area) of bat 1 can be widened to tapered portion 12. Therefore, even when the ball is hit at a boundary between hitting portion 11 and tapered portion 12 as is often experienced by amateur players or even at tapered portion 12, the flying distance of the ball can be increased as compared with the conventional example.

Next, referring to FIG. 4, a method of manufacturing the bat shown in FIGS. 1 to 3 will be described.

Figure 4:
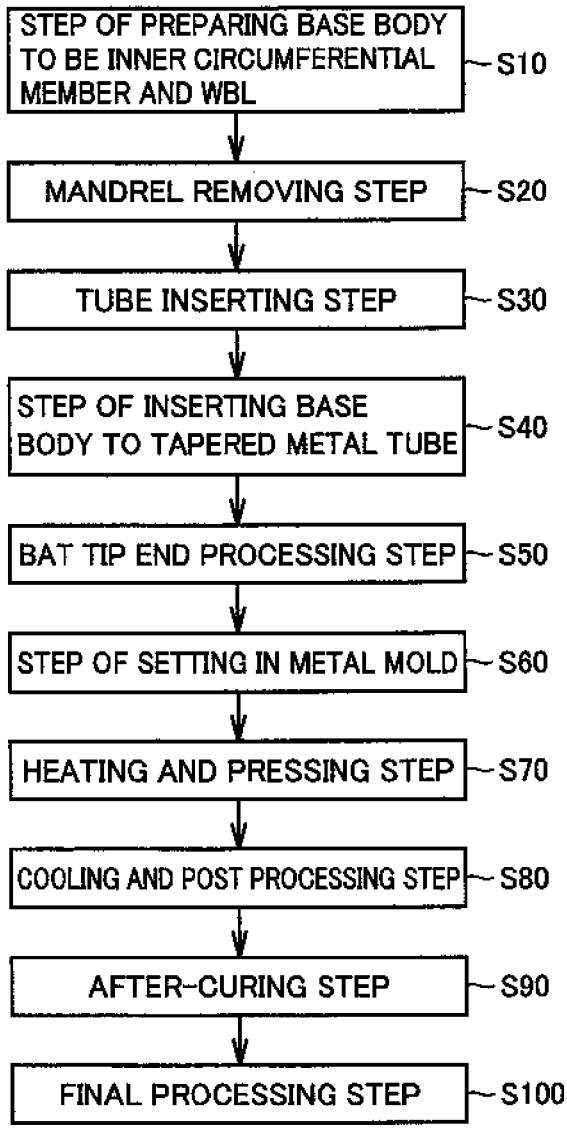
FIG. 4 is a flowchart representing a method of manufacturing the bat shown in FIGS. 1 to 3.

Referring to FIG. 4, first, the step (S10) of preparing a base body to be inner circumferential member 5 and non-adhesive member 7 is executed. At this step (S10), specifically, a glass sleeve, glass prepreg, carbon prepreg and the like are wound in a prescribed order on, for example, a mandrel (core metal). The glass prepreg, carbon prepreg and the like form the inner circumferential member 5 (see FIG. 2). After prescribed numbers of glass prepreg and carbon prepreg are wound on the mandrel, a resin film (such as a PP film) to be non-adhesive portion 7 as the WBL is wound on the outermost side.

Next, the mandrel removing step (S20) is executed. At this step (S20), the mandrel is removed from the inner circumferential side of the base body formed by glass sleeve, glass prepreg, carbon prepreg and PP film as described above.

Next, the tube inserting step (S30) is executed. At this step (S30), an air injecting tube is inserted and arranged on the inner circumference of the base body, so that pressure can be applied from the inner circumferential side of the base body in a pressing step, which will be described later.

Next, the step of inserting the base body to the inside of a tapered metal tube to be the outer circumferential member 3 is executed (S40). Here, the base body described above is arranged inside the tapered metal tube, which will be outer circumferential member 3. Specifically, the tapered metal tube is opened at the tip end side of the bat, and the base body is inserted through the opening. At this time, part of the base body is kept protruded from the above-described opening of the tapered metal tube.

Next, the bat tip end processing step (S50) is executed. Specifically, the part of base body protruding from the opening of tapered metal tube described above is bent to the outer side of tapered metal tube, so that the part of base body covers the outer circumferential portion of tapered metal tube. Thereafter, prepreg is further positioned on the part of base body bent outward from the opening of tapered metal tube, for reinforcement of the portion. Then, unnecessary portions of the prepreg is cut such that the prepreg comes to have approximately linear end surface at the end portion of prepreg positioned on the outer circumferential side of tapered metal tube (end portion on the side from tip end 10 to grip portion 13).

Next, the step of placing in a metal mold (S60) is executed. At this step (S60), the tapered metal tube having the above-described base body arranged therein is set in a metal mold. The metal mold has a recessed portion corresponding to the shape of the bat, and the tapered metal tube described above is set inside the recess. Further, a hose communicated with the tube in the base body is drawn out from the end portion of the bat to be the grip portion (rear end of the bat) to the outside of the metal mold. Here, as the metal mold, one that is divided into two parts in the up/down directions and having, in each part, a recess corresponding to the shape of the bat, may be used.

Next, the heating and pressing step (S70) is executed. Specifically, at this step (S70), the metal mold is pressed by a press machine and simultaneously, heated by a heater or the like. At this time, through the hose (air inlet pipe to the tube) drawn out of the metal mold from the portion to be the grip of the bat, high pressure air is supplied to the inside of the tube. As the high pressure air, air of at least 13 atm to at most 15 atm may be used. The heating temperature of the metal mold may be set to at least 100° C. and at most 170° C. and, preferably, at 150° C. The time of heating and pressing may be set to at least 20 minutes and at most 1 hour and, preferably to 30 minutes. In this manner, the tapered metal tube is press-processed along the shape of recess formed in the metal mold while high pressure air is supplied to the tube, so that the base body is pressed from the inside to the tapered metal tube, heated and cured, whereby the inner circumferential member is formed.

Next, the cooling and post processing step (S80) is executed. At this step (S80), the tapered metal tube molded to the shape of the bat is taken out from the mold, and the tapered metal tube is immersed in a coolant and cooled. As the coolant, water may be used. After the cooling step, the tube for air injection is taken out from the hole on the grip side (hole at the rear end of the bat), from the inside of tapered metal tube molded to the shape of the bat.

Next, the after-curing step (S90) is executed. At this step (S90), the tapered metal tube molded to the shape of the bat as described above is put in a drying chamber and heated for a prescribed time period. Thus, after-curing (that is, the step of fully curing prepreg forming the base body) is done. The drying temperature here may be set to at least 100° C. and at most 150° C. and, preferably, to 130° C. Further, the drying time may be set to at least 4 hours and at most 8 hours, and preferably, to 6 hours.

Thereafter, the final processing step (S100) is executed. At this step (S100), by way of example, the surface of tapered metal tube molded to the bat shape is polished, painted and dried. Further, a logo, mark and the like are printed on the surface of the tapered metal tube, and clear coating is provided. The coating is dried, and a grip end 15 (see FIG. 1) is fixed to the hole at the end of the grip portion (rear end of the bat). As the method of fixing, arbitrary method such as screw fixing, adhesion using an adhesive, or welding may be used. Then, grip tape is wound around grip portion 13. In this manner, the bat in accordance with the present invention shown in FIGS. 1 to 3 is provided.

Figure 5:
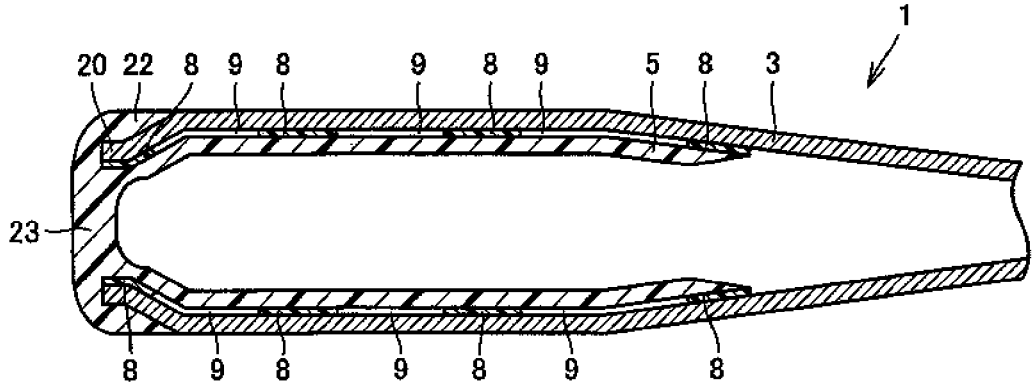
FIG. 5 is a partial schematic cross-section showing a modification of Embodiment 1 of the bat in accordance with the present invention.

Next, a modification of Embodiment 1 of the bat in accordance with the present invention will be described with reference to FIG. 5. FIG. 5 corresponds to FIG. 2.

Bat 1 shown in FIG. 5 basically has the same structure as the bat shown in FIGS. 1 to 3, with the shape of non-adhesive portion 8 made different from the shape of non-adhesive portion 7 of the bat shown in FIGS. 1 to 3. Specifically, in bat 1 shown in FIG. 5, non-adhesive portions 8 are arranged in a discrete manner with gaps 9 interposed, to be arranged at least partially in the region where unfixed portion of inner circumferential member 5 and outer circumferential member 3 are opposite to each other, between inner circumferential member 5 and outer circumferential member 3. In bat 1 shown in FIG. 5, non-adhesive portions 8 are each formed in a ring-shape, surrounding inner circumferential member 5. The shape of non-adhesive portion 8 is not limited to the ring, and island-shaped non-adhesive portions 8 may be arranged discretely and spaced from each other between inner circumferential member 5 and outer circumferential member 3. Two-dimensional shape of island-shaped non-adhesive portion 8 may be circular, polygonal or any other arbitrary shape. In the region between inner circumferential member 5 and outer circumferential member 3, the ratio of the area covered with non-adhesive portion 8 may be at least 50%, preferably at least 60%, and more preferably, at least 70%.

Bat 1 having such a structure can also attain the same effect as attained by the bat shown in FIGS. 1 to 3.

Embodiment 2

Figure 6:
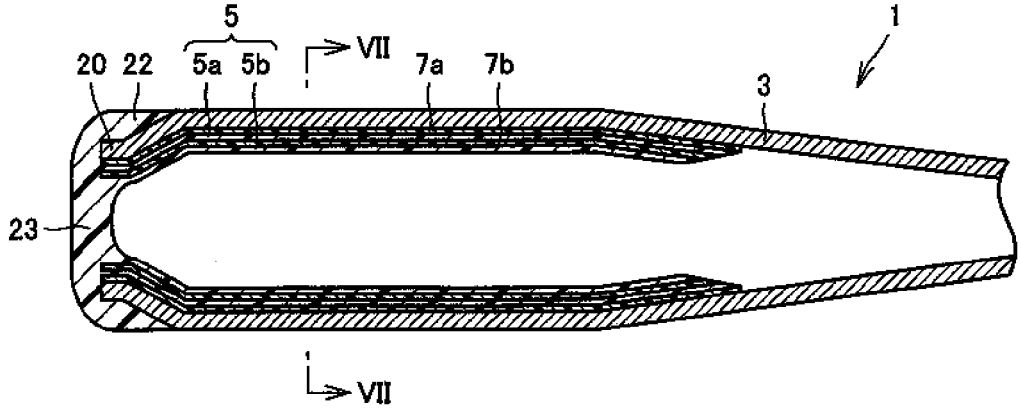
FIG. 6 is a partial schematic cross-section showing Embodiment 2 of the bat in accordance with the present invention.
Figure 7:
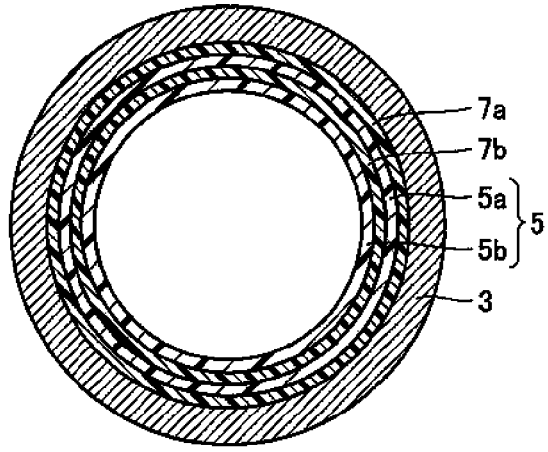
FIG. 7 is a schematic cross-section along line VII-VII of FIG. 6.

Referring to FIGS. 6 and 7, Embodiment 2 of the bat in accordance with the present invention will be described. FIGS. 6 and 7 correspond to FIGS. 2 and 3, respectively.

Bat 1 shown in FIGS. 6 and 7 basically has the same structure as the bat shown in FIGS. 1 to 3, with the structure of inner circumferential member 5 made different. Specifically, in bat 1 shown in FIGS. 6 and 7, inner circumferential member 5 consists of concentric inner circumferential member parts 5*a*, 5*b* and a non-adhesive portion 7*b*. Non-adhesive member 7*b* is positioned between inner circumferential member parts 5*a* and 5*b*. Non-adhesive portion 7*b* is arranged to extend from the taper side end portion 5 of inner circumferential member part 5*b* to the tip end 23 of the inner circumferential member. As a result, inner circumferential member parts 5*a* and 5*b* are movable independent from each other at the side of tapered portion 12, while they are connected on the side of tip end 23 of the inner circumferential member. Between inner circumferential member 5 and outer circumferential member 3 (that is, between the outer circumferential surface of inner circumferential member part 5*a* and the inner circumferential member 3), non-adhesive portion 7*a* is arranged.

Such a structure can also attain the same effect as attained by the bat shown in FIGS. 1 to 3.

Characteristic structure of bat 1 described above will be summarized. In bat 1 described above, inner circumferential member 5 consists of inner circumferential member parts 5*a* and 5*b* as a plurality of layers laminated with other non-adhesive portion or portions 7*b* interposed, in the radial direction of outer circumferential member 3. Tip side end portions (end portions on the side of tip end 23 of inner circumferential member) of inner circumferential member parts 5*a* and 5*b* as the plurality of layers are fixed to each other. At least one of the other non-adhesive portions (non-adhesive portion 7*b*) extends to the taper side end of the inner circumferential member. Further, in bat 1 described above, if there are a plurality of other non-adhesive portions, all of the non-adhesive portions may extend to the taper side end of inner circumferential member 5. Though two inner circumferential member parts 5*a* and 5*b* are shown in FIG. 6, the number of layers may be an arbitrary number not smaller than 3.

Here, as the inner circumferential member 5 is formed by inner circumferential member parts 5*a* and 5*b* as a plurality of layers, the number of layers that elastically deform independently when hitting the ball can be increased. This means that the number of layers that generate restoring force from elastic deformation increases. As a result, flying distance of the ball can surely be increased. Even when inner circumferential member parts 5*a* and 5*b* are made thin, total thickness of inner circumferential member 5 can be increased to some extent as there are a plurality of inner circumferential member parts, and hence, sufficient strength of the inner circumferential member can be ensured.

Figure 8:
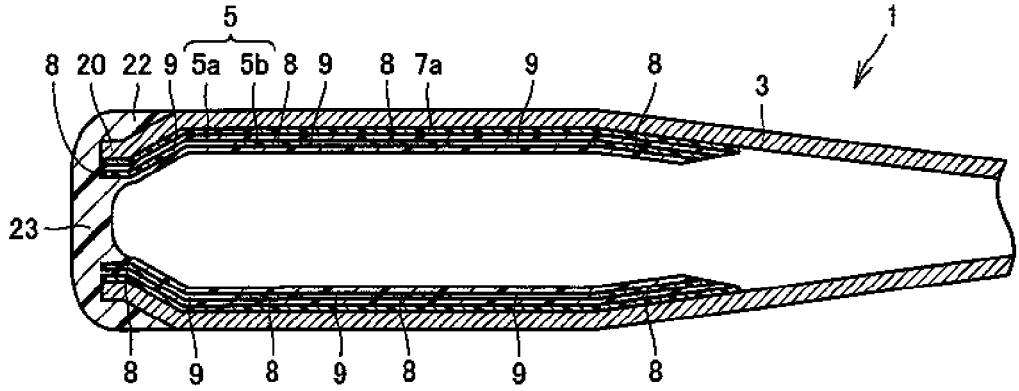
FIG. 8 is a partial schematic cross-section showing a modification of Embodiment 2 of the bat in accordance with the present invention.

Next, a modification of Embodiment 2 of the bat in accordance with the present invention shown in FIGS. 6 and 7 will be described with reference to FIG. 8. FIG. 8 corresponds to FIG. 6.

Bat 1 shown in FIG. 8 basically has the same structure as the bat shown in FIGS. 6 and 7, with the shape of non-adhesive portion 8 made different from the shape of non-adhesive portion 7*b* of bat 1 shown in FIGS. 6 and 7. Specifically, in bat 1 shown in FIG. 8, non-adhesive portions 8 are arranged in a discrete manner with gaps 9 interposed, between inner circumferential member parts 5*a* and 5*b*. In bat 1 shown in FIG. 8, non-adhesive portions 8 are each formed in a ring-shape, surrounding inner circumferential member part 5*b*. Similar to the non-adhesive portion 8 of bat 1 shown in FIG. 5, the shape of non-adhesive portion 8 is not limited to the ring, and island-shaped non-adhesive portions 8 may be arranged discretely and spaced from each other between inner circumferential member parts 5*a* and 5*b*. Two-dimensional shape of island-shaped non-adhesive portion 8 may be circular, polygonal or any other arbitrary shape. In the region between inner circumferential member parts 5*a* and 5*b*, the ratio of the area covered with non-adhesive portion 8 may be at least 50%, preferably at least 60%, and more preferably, at least 70%.

Bat 1 having such a structure can also attain the same effect as attained by the bat shown in FIGS. 1 to 3.

In bat 1 shown in FIG. 8, non-adhesive portion 7*a* may be non-adhesive portions 8 arranged discretely as shown in FIG. 5. In that case, non-adhesive portions arranged between inner circumferential member parts 5*a* and 5*b* may be positioned not to be overlapped (or partially overlapped but not fully overlapped) with the non-adhesive portions 8 arranged between inner circumferential member part 5*a* and outer circumferential member 3, when viewed two-dimensionally.

Embodiment 3

Figure 9:
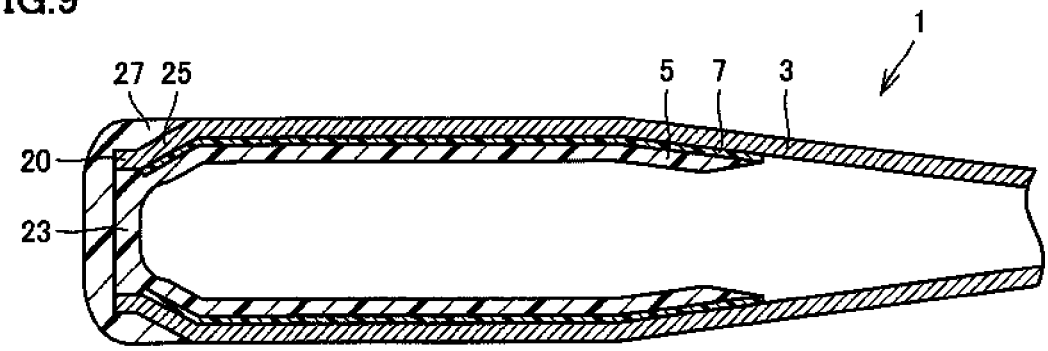
FIG. 9 is a partial schematic cross-section showing Embodiment 3 of the bat in accordance with the present invention.

Embodiment 3 of the bat in accordance with the present invention will be described with reference to FIG. 9. FIG. 9 corresponds to FIG. 2.

Referring to FIG. 9, bat 1 of the present invention basically has the same structure as the bat shown in FIGS. 1 to 3, with the structure of tip end portion of the bat made different. Specifically, in the bat shown in FIG. 9, as a member forming the tip end portion of bat 1, a cap member 27 is arranged to cover the end portion of outer circumferential member 3, separate from inner circumferential member 5. Cap member 27 is adhered to the outer surface of outer circumferential member 3 at tip end portion 10 (see FIG. 1) of the bat. Further, tip end 23 of inner circumferential member is arranged to fill the opening at the tip end 20 of outer circumferential member. The surface of tip end 20 of outer circumferential member as the inner circumferential surface of the opening and the outer circumferential surface of tip end 23 of inner circumferential member are adhered to each other. As a result, outer circumferential member 3 and inner circumferential member 5 are fixed at the tip end side of bat 1.

Such a structure can also attain the same effect as attained by the bat shown in FIGS. 1 to 3.

Characteristic structure of bat 1 described above will be summarized. Bat 1 described above includes cap member 27 that covers the end portion (tip end 20 of outer circumferential member) opposite to the taper side end of outer circumferential member 3. Here, as tip end 20 of outer circumferential member 3, that is, the tip end of the bat of outer circumferential member 3 is covered by cap member 27, the outer circumferential member 3 at the tip end of bat 1 can be prevented from directly bumping against the ground, when the batter lets go of the bat 1 after hitting. Thus, possible damage to outer circumferential member 3 at the tip side end of the bat (tip end 20 of outer circumferential member) caused by bumping against the ground can be decreased.

Embodiment 4

Figure 10:
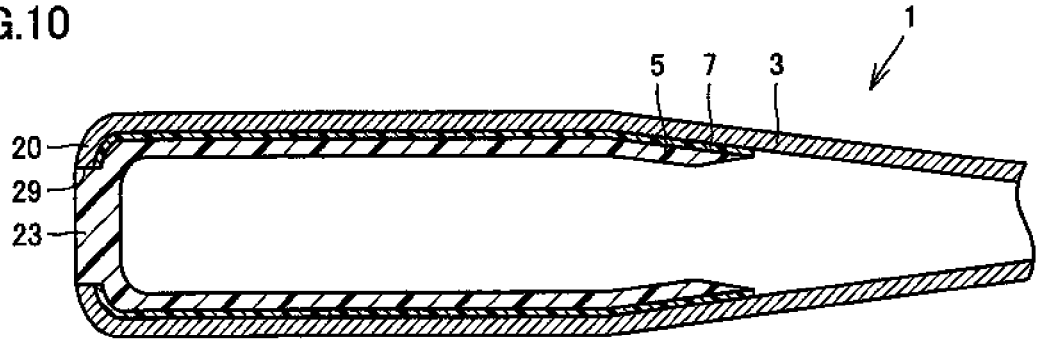
FIG. 10 is a partial schematic cross-section showing Embodiment 4 of the bat in accordance with the present invention.

Embodiment 4 of the bat in accordance with the present invention will be described with reference to FIG. 10. FIG. 10 corresponds to FIG. 2.

Bat 1 shown in FIG. 10 basically has the same structure as the bat shown in FIGS. 1 to 3, with the structure of tip end portion made different. Specifically, in bat 1 shown in FIG. 10, at the tip end portion of the bat, outer circumferential member 3 forms a part of the end surface of bat 1. On the end surface of tip end side of bat 1, an opening 29 is formed in outer circumferential member 3. Tip end 23 of inner circumferential member is arranged to fill the opening 29. A side wall of opening 29 (surface of tip end 20 of outer circumferential member) is adhered to the outer circumferential surface of tip end 23 of inner circumferential member, and hence, outer circumferential member 3 and inner circumferential member 5 come to be connected and fixed, at the tip end side of bat 1. Further, non-adhesive portion 7 extends from the taper end side of inner circumferential member 5 to a portion adjacent to the inner circumferential sidewall at opening 29 of outer circumferential member 3.

Bat 1 having such a structure can also attain the same effect as attained by the bat shown in FIGS. 1 to 3.

Characteristic structure of the bat described above will be summarized. In bat 1 described above, outer circumferential member 3 includes, at a tip end opposite to the taper side end (tip end of the bat), a portion to be an end sidewall (tip end 20 of outer circumferential member) forming a part of an end surface of bat 1. Opening 29 is formed at the portion (tip end 20 of outer circumferential member) that will be the part of end sidewall of outer circumferential member 3. Inner circumferential member 5 includes tip end 23 of inner circumferential member, which is a portion to fill the opening 29 and to be adhered to the inner wall of opening 29.

Here, it is unnecessary to separately prepare a cap member that covers the end surface of bat 1 (end surface on the tip end side of the bat). Therefore, the number of components and the number of manufacturing steps of bat 1 can be reduced. Thus, the manufacturing cost of bat 1 can be reduced.

Embodiment 5

Figure 11:
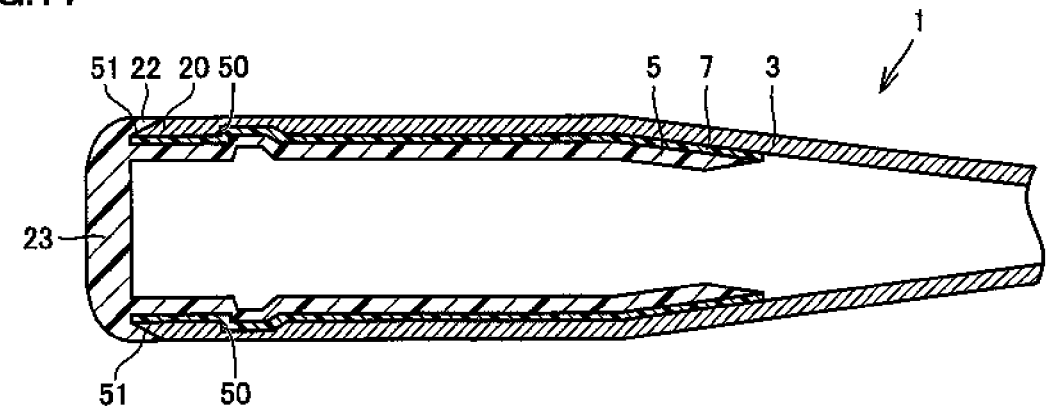
FIG. 11 is a partial schematic cross-section showing Embodiment 5 of the bat in accordance with the present invention.

Embodiment 5 of the bat in accordance with the present invention will be described with reference to FIG. 11. FIG. 11 corresponds to FIG. 2.

Referring to FIG. 11, bat 1 of the present invention basically has the same structure as the bat shown in FIGS. 1 to 3, with the structure of tip end portion of the bat made different. Specifically, in the bat shown in FIG. 11, outer circumferential member 3 has a cylindrical shape of substantially the same outer diameter, from the hitting portion to the tip end portion of bat 1. At the tip end portion of bat 1 (tip end 20 of outer circumferential member), outer diameter of outer circumferential member 3 is made gradually smaller, while the inner diameter of outer circumferential member is kept approximately constant. Specifically, tip end 20 of outer circumferential member has a tapered cross section, which becomes thinner to the tip end side.

Further, outer circumferential member 3 has a recess 50 formed on the inner circumference at the tip end side. Recess 50 is an annular trench formed around the inner circumference of outer circumferential member 3. At recess 50, sidewall on the side of grip portion of bat 1 is inclined to the inner circumference of outer circumferential member 3.

Inner circumferential member 5 is arranged to fill the tip end side opening of outer circumferential member 3 and to extend along the inner circumference of outer circumferential member 3. Between the inner circumferential member 5 and the inner circumferential surface of outer circumferential member 3, non-adhesive portion 7 is arranged. Non-adhesive portion 7 extends to the taper side end of inner circumferential member 5. Non-adhesive portion 7 and inner circumferential member 5 include bent portions conforming to the shape of recess 50, to fill the inside of recess 50 formed at the inner circumferential surface of outer circumferential member 3.

Inner circumferential member 5 includes an extension 22 of inner circumferential member, continuous to tip end 23 of inner circumferential member and extending over the outer circumferential surface of tip end 20 of outer circumferential member. Extension 22 of inner circumferential member and outer circumferential member 3 are connected and fixed at tip end tapered portion 51. Such a structure can also attain the same effect as attained by the bat shown in FIGS. 1 to 3.

The depth of recess 50 may be at most 50% of the thickness of outer circumferential member 3. Further, the length of recess 50 in the direction of extension of bat 1 may be about 10 mm. Further, recess 50 may not be an annular trench but independent recesses formed at a plurality of positions in the circumferential direction, on the inner circumference of outer circumferential member 3. Here, the plurality of recesses may be arranged at equal distance. Further, in the direction of extension of bat 1, recesses 50 may be arranged at a plurality of portions (for example, at two or more portions).

In Embodiments 1 to 5 of the bat in accordance with the present invention described above, arbitrary material may be used as materials of outer circumferential member 3 and inner circumferential member 5. By way of example, metal such as aluminum alloy may be used as outer circumferential member 3, and fiber-reinforced plastic (FRP) or other material may be used for inner circumferential member 5. Outer circumferential member 3 and inner circumferential member 5 may be formed of different materials as described above, or the members may be formed of the same material.

Thickness of outer circumferential member 3 and inner circumferential member 5 at the hitting portion may be arbitrarily determined. For instance, when aluminum alloy is used for outer circumferential member 3 of an "adult-size baseball bat", thickness of outer circumferential member 3 may be set to at least 0.5 mm and at most 3.0 mm and, more preferably, at least 1.0 mm and at most 2.5 mm. When FRP is used for inner circumferential member 5, the thickness may be set to at least 0.5 mm and at most 7.0 mm, and more preferably, at least 2.0 mm and at most 5.0 mm.

Further, as non-adhesive portion 7, any material may be arranged in place of the PP film described above, provided that the material prevents adhesion between outer circumferential member 3 and inner circumferential member 5. By way of example, as non-adhesive portion 7, a releasing film of polyethylene, silicone or the like may be used. Alternatively, a layer formed by spraying an arbitrary releasing agent to the outer circumferential surface of inner circumferential member 5 and/or to the inner circumferential surface of outer circumferential member 3 may be used as non-adhesive portion 7. Further, a structure in which surfaces of outer circumferential member 3 and of inner circumferential member 5 are not adhered to each other but in slidable and/or separable contact, without any particular layer such as the PP film, may be used, as non-adhesive portion 7. In Embodiments 3 to 5 of the bat in accordance with the present invention, the structures of the non-adhesive portion and inner circumferential member such as shown in FIGS. 5 to 8 may be applied.

(Test 1)

In order to confirm the effects of the bat in accordance with the present invention, bats in accordance with the embodiments of the invention and comparative examples are manufactured, and restitution coefficient of each bat was measured.

(Samples)

Figure 12:
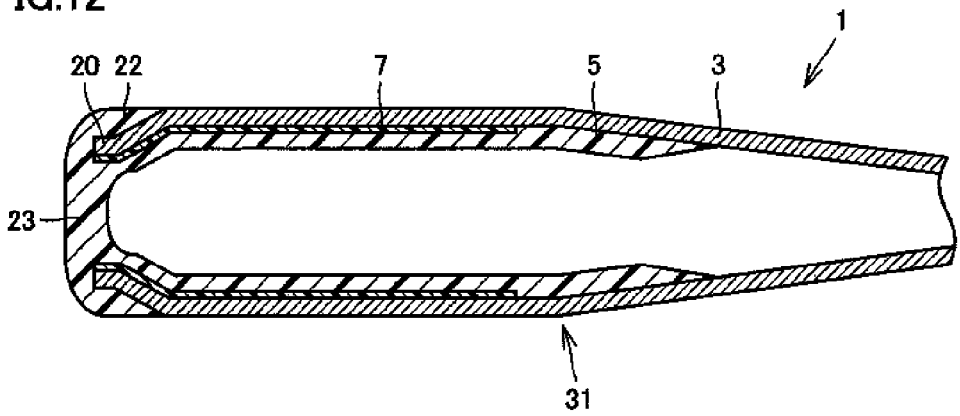
FIG. 12 is a partial schematic cross-section illustrating a sample of Comparative Example 1 prepared for the embodiment of the present invention.
Figure 13:
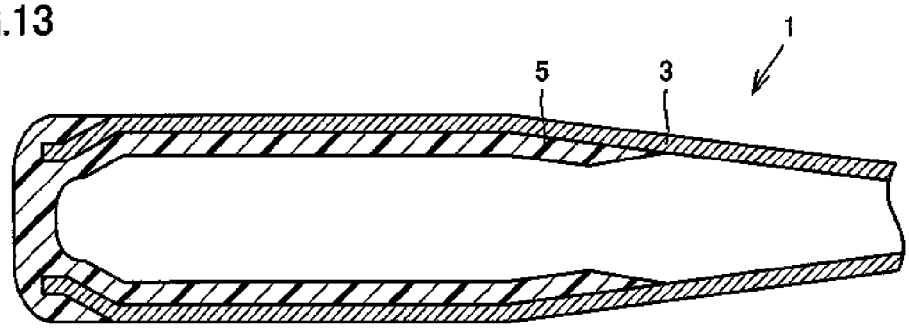
FIG. 13 is a partial schematic cross-section illustrating a sample of Comparative Example 2 prepared for the embodiment of the present invention.

Specifically, samples of four different types, that is, bats in accordance with Embodiments 1 and 2 and Comparative Examples 1 and 2 were prepared. The bat in accordance with Embodiment 1 basically has the structure shown in FIGS. 1 to 3. The bat in accordance with Embodiment 2 basically has the structure shown in FIGS. 6 and 7. Specifically, as outer circumferential member 3, aluminum alloy (JIS: A7050) was used. As inner circumferential member 5, FRP was used. As non-adhesive portion 7, a PP film was used. Bats in accordance with Comparative Examples 1 and 2 had the structures shown in FIGS. 12 and 13.

The bat in accordance with Comparative Example 1 basically has a structure similar to that shown in FIGS. 1 to 3, except that non-adhesive portion 7 extends only from the tip end side to a middle of hitting portion of bat 1. As a result, in the bat shown in FIG. 12, inner circumferential member 5 adheres to outer circumferential 5 member 3 at opposite ends, that is, the tip end side and tapered portion of bat 1.

The bat in accordance with Comparative Example 2 basically has a structure similar to that shown in FIGS. 1 to 3, except that non-adhesive portion 7 is not at all provided. As a result, the outer circumferential surface of inner circumferential member 5 is entirely connected and fixed to the inner circumferential surface of outer circumferential member 3. Length and mass, positions of center of mass, moment of inertia, positions of center of hitting, outer diameter of hitting portion, thickness of outer circumferential member at the hitting portion and thickness of inner circumferential member at the hitting portion of the bats in accordance with Embodiments 1 and 2 and Comparative Examples 1 and 2 are as shown in Table 1.

TABLE 1

| Material type | Length (mm/inch) | Weight (g/oz) | COM (Center of mass) (mm) | MOI (Moment of Inertia) (kg · cm · sec$^2$) | COP (Center of Percussion) (mm) | Hitting portion diameter (mm) | Outer member thickness at hitting portion (mm) | Inner member thickness at hitting portion (mm) | Remarks |
|---|---|---|---|---|---|---|---|---|---|
| Embodiment 1 | 837/33.0 | 892/31.5 | 524 | 2.18 | 689 | 66.5 | 1.5 | 3.5 | Adhesion preventing layer (WBL) formed of 2 films extends 32 cm from tip end |
| Embodiment 2 | 837/33.0 | 890/31.4 | 524 | 2.18 | 690 | 66.5 | 1.5 | 3.5 | 2 adhesion preventing layers (WBL) formed of 2 films are provided |
| Comparative Example 1 | 837/33.0 | 885/31.2 | 525 | 2.17 | 689 | 66.5 | 1.5 | 3.5 | Adhesion preventing layer (WBL) formed of 2 films extends 22 cm from tip end |
| Comparative Example 2 | 837/33.0 | 885/31.2 | 525 | 2.18 | 692 | 66.5 | 1.5 | 3.5 | Adhesion preventing layer not provided |

* Film thickness: 0.02 mm (Measurement)

Figure 14:
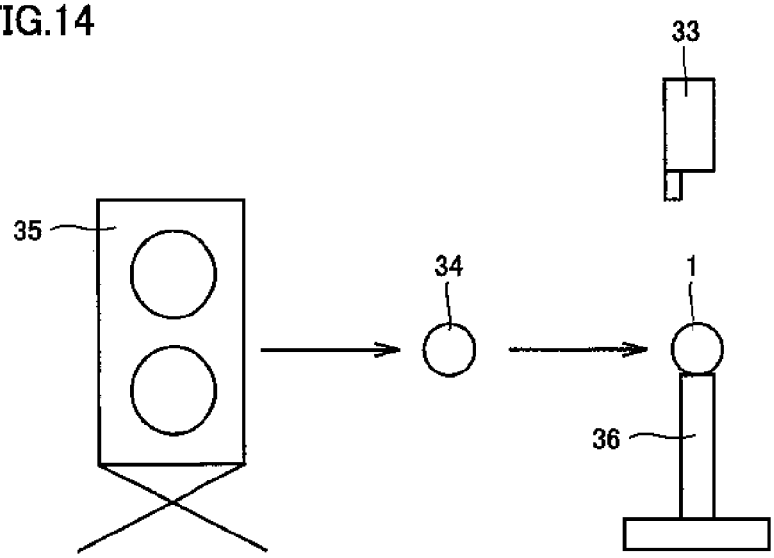
FIG. 14 is a schematic illustration showing a structure of a measuring apparatus used for measuring restitution coefficient.

The restitution coefficient was measured by the following method, using the apparatus arrangement shown in FIG. 14. The method of measuring the restitution coefficient will be described with reference to FIG. 14.

As shown in FIG. 14, for measuring the restitution coefficient, bat 1 as an object of measurement was placed on a bat base 36, and using a pitching machine 35, a ball 34 was got hit by bat 1. The manner how ball 34 impacts against bat 1 was picked-up by a high-speed video camera 33. High-speed video camera 33 is arranged immediately above bat 1 and picks up the image of ball 34 impacting against bat 1 from above. From the video images picked-up by high-speed video camera 33, velocity (barycentric velocity) of ball 34 before impacting against bat 1, velocity (barycentric velocity) of ball 34 after impacting against bat 1 and velocity of movement (barycentric velocity) of bat 1 are measured.

Using these measurement data, restitution coefficient "e" is calculated in accordance with the equation below.

$$e=-\{V_BL(\mathrm{OUT})-(V_BT(\mathrm{PAL})+a\cdot V_BT(\mathrm{ROT}))\}/V_BL(\mathrm{IN})$$

e: restitution coefficient

V_BL(IN): Barycentric velocity of ball before impact (m/s)

V_BL(OUT): Barycentric velocity of ball after impact (m/s)

V_BT(PAL): Translational velocity of the center of mass of bat after impact (m/s)

V_BT(ROT): Angular velocity of bat around the center of mass after impact (rad/s)

a: Distance from the center of mass of bat to position of ball impact (grip side being positive).

Figure 15:
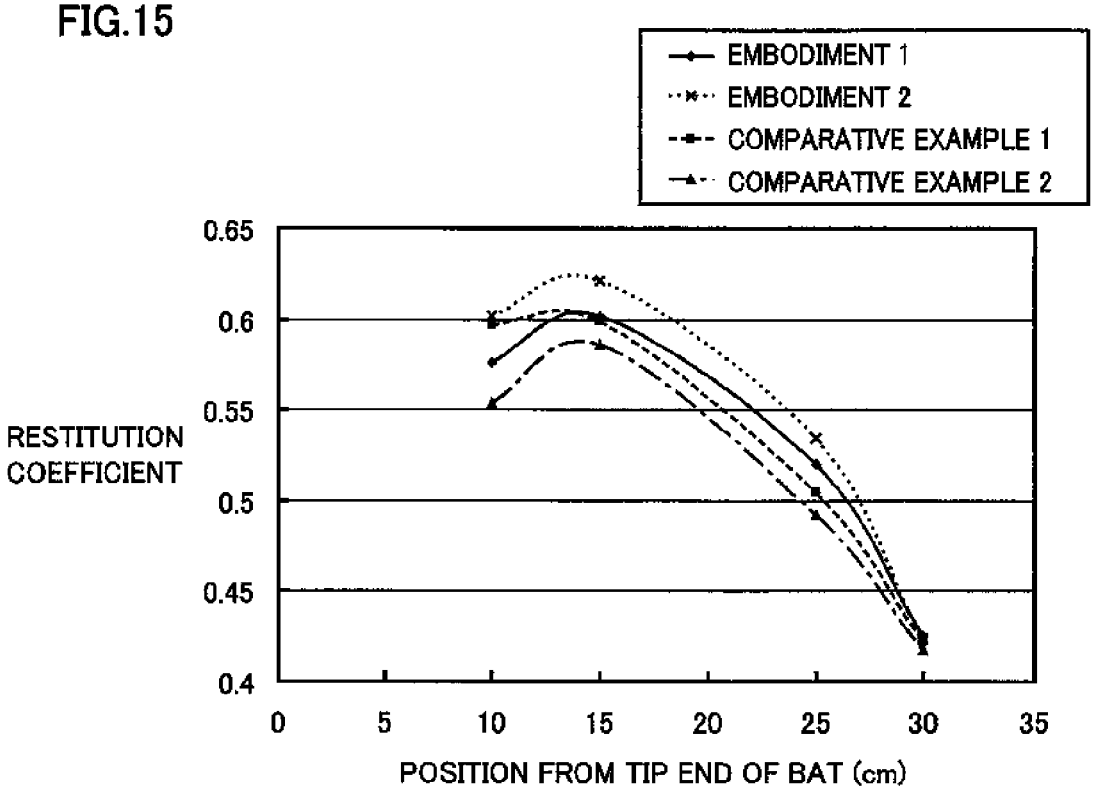
FIG. 15 is a graph showing result of measurement of restitution coefficients, measured for samples of Embodiment 1 and Embodiment 2 of the present invention and Comparative Example 1 and Comparative Example 2.

Resulting data are as shown in Table 2 and FIG. 15.

TABLE 2

| | Position from tip end (cm) | | | |
|---|---|---|---|---|
| Material type | 10 | 15 | 25 | 30 |
| Embodiment 1 | 0.576 | 0.602 | 0.520 | 0.425 |
| Embodiment 2 | 0.602 | 0.621 | 0.534 | 0.424 |
| Comparative Example 1 | 0.597 | 0.599 | 0.504 | 0.422 |
| Comparative Example 2 | 0.554 | 0.586 | 0.492 | 0.417 |

Referring to FIG. 15, the abscissa represents the position from the tip end of the bat, and the ordinate represents the restitution coefficient. As can be seen from FIG. 15, regarding the area having the restitution coefficient of 0.5 or higher as the sweet area, the sweet area is wider to the taper side of the bat in samples in accordance with Embodiments 1 and 2 of the invention than in the samples in accordance with Comparative Examples 1 and 2. For example, let us consider the position 25 cm from the tip end, having the highest restitution coefficient as the sweet spot. The width of the sweet area is evaluated by the position at the end of the sweet area. Here, when the position of the end is represented by the distance from the sweet spot, it is 12 cm in Embodiment 1 and 13 cm in Embodiment 2 of the present invention. The distance is 9 cm in Comparative Example 2. Specifically, when the width of sweet area is considered in terms of the distance from the sweet spot, it is 33% wider in Embodiment 1 and 44% wider in Embodiment 2, than Comparative Example 2. Further, restitution coefficient at the sweet spot is increased due to the formation of non-adhesive portion in the bats of Embodiments 1 and 2, as compared with Comparative Example 2.

As described above, it can be understood that restitution coefficient can be increased and wider sweet area can be provided by the bats in accordance with the embodiments of the present invention.

(Test 2)

Logarithmic decrement was measured, using the bat samples of Embodiments 1 and 2 and Comparative Examples 1 and 2 described above.

(Measurement)

Figure 16:
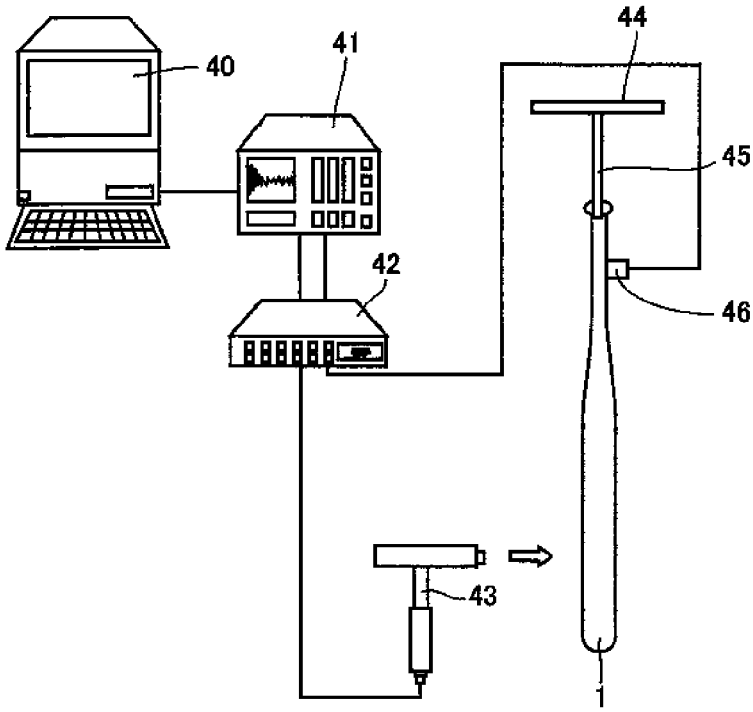
FIG. 16 is a schematic illustration showing a structure of a measuring apparatus used for measuring logarithmic decrement.

Here, logarithmic decrement was measured by the following method, using the apparatus arrangement shown in FIG. 16. The method of measuring the logarithmic decrement will be described with reference to FIG. 16.

As shown in FIG. 16, the apparatus used for measuring logarithmic decrement (vibration damping measuring apparatus) includes a bat hanging base 44, a chemical fiber string 45, an impulse hammer 43, an acceleration meter 46, a signal conditioner 42, an FFT (Fast Fourier Transformation) analyzer 41, and a computer 40 as a controller.

Using such an apparatus arrangement, first, bat 1 is hung from bat hanging base 44, using string 45. String 45 is connected to the grip side of bat 1. Acceleration meter 46 was set at the position 21 cm from the grip side end of the bat. Acceleration meter 46 is connected to signal conditioner 42. Further, impulse hammer for hitting bat 1 is also connected to signal conditioner 42. Signal conditioner 42 is connected to computer 40 through FFT analyzer 41.

With this apparatus arrangement, measurement was done in the following manner.

First, bat 1 is hit by impulse hammer 43. The hitting position was 30 cm from the head side (tip side) end of bat 1. Hitting by impulse hammer 43 is done such that the point of measurement (position of acceleration meter) faces the same direction as the hitting point. Vibration of bat 1 caused by the hitting is measured as time-sequential data, by acceleration meter 46.

Here, eigenfrequency of primary bending vibration of the bat is about 200 Hz, and therefore, the range of frequency to be measured was set to 0 to 250 Hz. The time of measurement was 3 seconds. By analyzing the result of measurement by FFT analyzer 41, vibration damping was measured. The result of measurement is displayed/recorded by computer 40.

As impulse hammer 43, acceleration meter 46, signal conditioner 42 and FFT analyzer 41, apparatuses of type 208A04 of PCB PIEZOTRONICS INC, type 352A21 of PCB PIEZOTRONICS. INC, type 483A of PCB PIEZOTRONICS INC. and type DS-9110 of ONO SOKKI Kabushiki Kaisha, respectively, were used.

Figure 17:
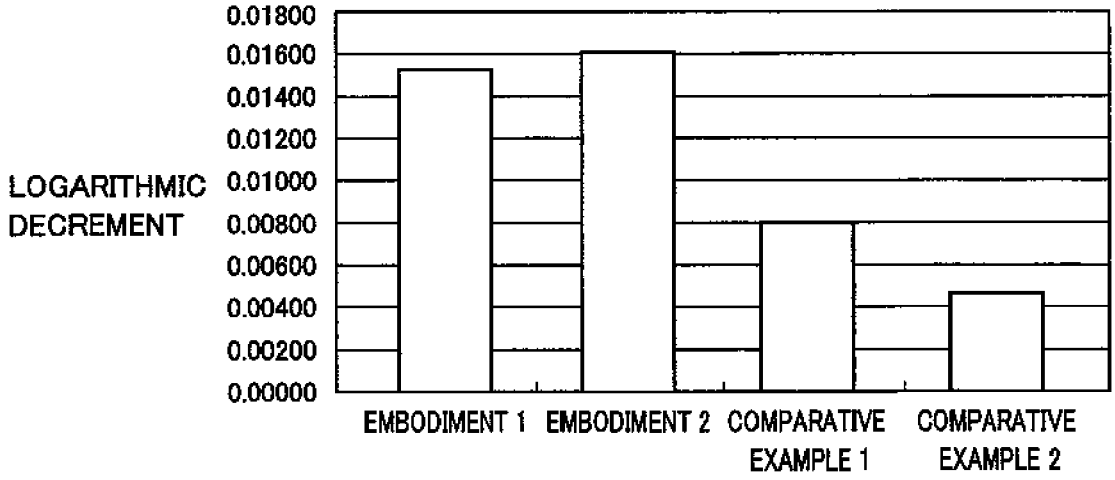
FIG. 17 is a graph showing result of measurement of logarithmic decrement of Embodiment 1, Embodiment 2, Comparative Example 1 and Comparative Example 2.

The results of measurement are as shown in FIG. 17. As shown in FIG. 17, it can be seen that the logarithmic decrement of the embodiments is approximately twice as high as Comparative Example 1 and approximately three times as high as Comparative Example 3. High logarithmic decrement means that vibration at the time of hitting the ball attenuates faster. Specifically, in bats in accordance with Embodiments 1 and 2 of the present invention, vibration of the bat at the time of hitting attenuates faster than Comparative Examples 1 and 2, and hence, the problem such as player's hand going numb because of bat vibration can be curbed.

(Test 3)

Eigenfrequency at the hitting portion of the four samples described above was measured. The measurement was done in accordance with the following method.

Figure 18:
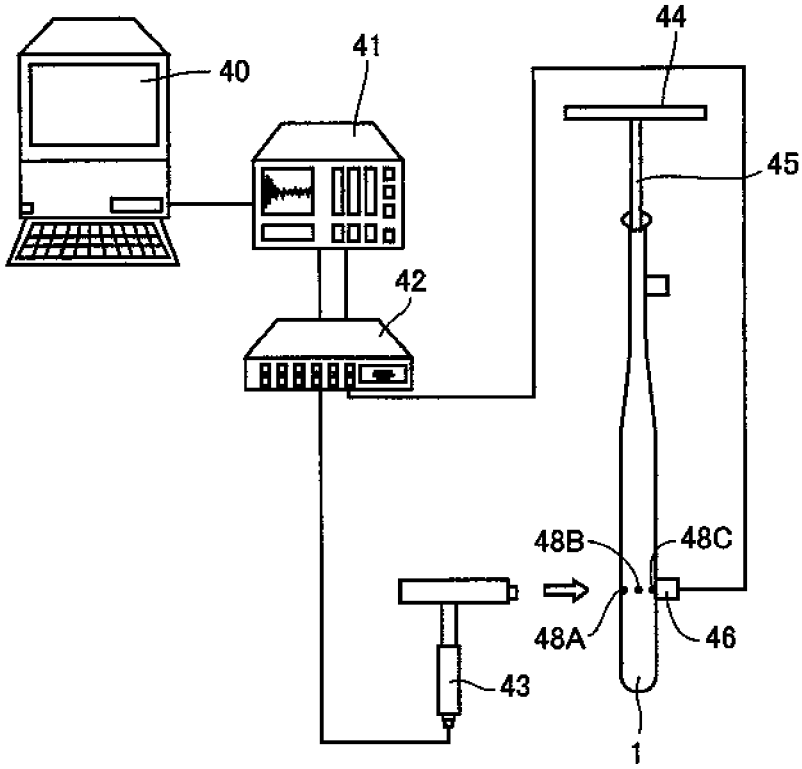
FIG. 18 is a schematic illustration showing a structure of a measuring apparatus used for measuring eigenfrequency of hitting portion of the bat.

Referring to FIG. 18, the apparatus used for measuring the eigenfrequency at the hitting portion (vibration damping measuring apparatus) includes, similar to the vibration damping measuring apparatus used in Test 2, bat hanging base 44, chemical fiber string 45, impulse hammer 43, acceleration meter 46, signal conditioner 42, FFT (Fast Fourier Transformation) analyzer 41, and computer 40 as a controller.

Using such an apparatus arrangement, first, bat 1 is hung from bat hanging base 44, using string 45. String 45 is connected to the grip side of bat 1. Acceleration meter 46 was set at the position 10 cm from the head (tip) side end of the bat. Acceleration meter 46 is connected to signal conditioner 42. Further, impulse hammer for hitting bat 1 is also connected to signal conditioner 42. Signal conditioner 42 is connected to computer 40 through FFT analyzer 41.

With this apparatus arrangement, measurement was done in the following manner.

First, bat 1 is hit by impulse hammer 43. The hitting position was 10 cm from the head side (tip side) end of bat 1. As to the hitting portion, a plurality of hitting points (for example, 16 points) are set at approximately equal interval in the circumferential direction of the bat, as represented by hitting points 48*a* to 48*c* of FIG. 18. One of the 16 hitting points is determined to be the measurement point for setting acceleration meter 46, and only the point where the hitting point and measuring point overlap, the hitting position is displaced by 10 mm to the grip side.

Then, the bat is hit by impulse hammer 43 and vibration of bat 1 caused by the hitting is measured as time-sequential data by acceleration meter 46. By analyzing the result of measurement by FFT analyzer 41, vibration damping was measured. The result of measurement is displayed/recorded by computer 40.

Impulse hammer 43, acceleration meter 46, signal conditioner 42 and FFT analyzer 41 are the same apparatuses as those used in Test 2.

As a result, eigenfrequency of the bat in accordance with Embodiment 1 of the present invention was 2700 Hz, eigenfrequency of the bat in accordance with Embodiment 2 was 2200 Hz, eigenfrequency of the bat in accordance with Comparative Example 1 was 2875 Hz, and eigenfrequency of the bat in accordance with Comparative Example 2 was 3600 Hz. The smaller eigenfrequency represents better restitution of the bat. Specifically, also from the results of measurement described above, it can be seen that the bats in accordance with the present invention exhibited smaller eigenfrequencies than the bats in accordance with Comparative Examples 1 and 2. That the eigenfrequency is small means the bat has superior restitution characteristic.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A baseball or softball bat, including a tip portion, a ball hitting portion, a tapered portion and a grip portion, comprising:

a cylindrical outer circumferential member constituting at least part of said ball hitting portion and at least part of the tip portion, wherein the diameter of the outer circumferential member at the tip portion of the bat is smaller than the diameter of the outer circumferential member at the ball hitting portion, the outer circumferential member having an inner surface and an outer surface;

an inner circumferential member disposed proximate the inner surface of said outer circumferential member, the inner circumferential member having a tip side end positioned opposite to a tapered side end, fixed to said outer circumferential member, the tip side end of the inner circumferential member extending from the inner surface of the outer circumferential member to the outer surface of the outer circumferential member, wherein the tip side end is adhered to the outer surface of the outer circumferential member; and a non-adhesive portion for preventing adhesion between said outer circumferential member and an unfixed portion of said inner circumferential member other than said tip side end and including said taper side end, provided on at least a part of a region of said inner circumferential member where said unfixed portion and said outer circumferential member are opposite to each other.

2. The baseball or softball bat according to claim 1, wherein said non-adhesive portion extends to said taper side end of said inner circumferential member.

3. The baseball or softball bat according to claim 1, wherein said inner circumferential member consists of a plurality of layers laminated in a radial direction of said outer circumferential member with other non-adhesive portions interposed;

said tip side ends of said plurality of layers are fixed to each other; and at least one of said other non-adhesive portions extends to said taper side end of said inner circumferential member.

4. The baseball or softball bat according to claim 3, wherein said other non-adhesive portions all extend to said taper side end of said inner circumferential member.

5. The baseball or softball bat according to claim 1, comprising a cap member covering an end portion opposite to said taper side end of said inner circumferential member.

6. The baseball or softball bat according to claim 5, wherein said cap member and said inner circumferential member are integrally molded.

7. The baseball or softball bat according to claim 1, wherein said non-adhesive portion is formed of at least one of a releasing film and a releasing agent.

8. The baseball or softball bat according to claim 1, wherein said inner circumferential member extends from said ball hitting portion to said tapered portion.

* * * * *